US012672754B2

(12) United States Patent
Roderick et al.

(10) Patent No.: US 12,672,754 B2
(45) Date of Patent: Jul. 7, 2026

(54) DISHWASHER

(71) Applicant: WHIRLPOOL CORPORATION, Benton Harbor, MI (US)

(72) Inventors: Frederick Thomas Roderick, Coloma, MI (US); Mark Steven Feddema, Kalamazoo, MI (US); Joseph Allen Gregory, Niles, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 52 days.

(21) Appl. No.: 18/541,316

(22) Filed: Dec. 15, 2023

(65) Prior Publication Data

US 2024/0108193 A1 Apr. 4, 2024

Related U.S. Application Data

(63) Continuation of application No. 17/365,015, filed on Jul. 1, 2021, now Pat. No. 11,849,900.

(51) Int. Cl.

| | |
|---|---|
| ***A47L 15/42*** | (2006.01) |
| ***A47L 15/00*** | (2006.01) |
| ***A47L 15/22*** | (2006.01) |

(52) U.S. Cl.

CPC ..... *A47L 15/4282* (2013.01); *A47L 15/0007* (2013.01); *A47L 15/22* (2013.01)

(58) Field of Classification Search

None

See application file for complete search history.

(56) References Cited

U.S. PATENT DOCUMENTS

| | | | | |
|---|---|---|---|---|
| 2,987,260 | A | 6/1961 | Sasnett | |
| 3,468,486 | A | 9/1969 | Mercer | |
| D748,352 | S | 1/2016 | Baldwin et al. | |
| 9,693,672 | B2 * | 7/2017 | Feddema | A47L 15/23 |
| 9,962,058 | B2 * | 5/2018 | Shin | A47L 15/4209 |
| 2016/0000295 | A1 | 1/2016 | Caballaro | |
| 2022/0110503 | A1 | 4/2022 | Feddema | |

FOREIGN PATENT DOCUMENTS

| | | | |
|---|---|---|---|
| CN | 211583002 | U | 9/2020 |
| DE | 10134917 | A1 | 2/2003 |
| DE | 102007017114 | A1 | 10/2008 |
| DE | 102010001654 | A1 | 8/2011 |
| DE | 102010043021 | A1 | 5/2012 |
| WO | 2015004612 | A1 | 1/2015 |
| WO | 2018/103952 | A1 | 6/2018 |

OTHER PUBLICATIONS

European Extended Search report corresponding to EP22181281.1 mailed Nov. 23, 2022.

* cited by examiner

*Primary Examiner* — Rita P Adhlakha

(74) *Attorney, Agent, or Firm* — McGarry Bair PC

(57) ABSTRACT

A dishwasher for treating dishes according to a cycle of operation, the dishwasher comprising a tub at least partially defining a treating chamber; a dish rack movably received within the treating chamber, configured for receiving dishes for treatment during the cycle of operation, and moveable relative to the tub; a sprayer located within the treating chamber, configured to emit spray into the dish rack; and a deflector having a base portion fixed to the sprayer, wherein the deflector includes at least one wall that extends away from the base portion such that the at least one wall is positioned to prevent contact between the dishes in the dish rack and the sprayer.

19 Claims, 9 Drawing Sheets

DISHWASHER

CROSS-REFERENCE TO RELATED APPLICATIONS

This application is a continuation application of U.S. patent application Ser. No. 17/365,015, filed Jul. 1, 2021, now U.S. Pat. No. 11,849,900, issued Dec. 26, 2023, the disclosure of which is hereby incorporated by reference in its entirety as though fully set forth herein.

BACKGROUND

Contemporary automatic dish treating appliances for use in a typical household include a cabinet with an access opening and a tub that can have an open front and at least partially defines a treating chamber into which items, such as kitchenware, glassware, and the like, can be placed to undergo a treating operation, such as washing. At least one rack or basket, generally referred to as a dish rack, for supporting soiled dishes can be provided within the tub. A silverware or utensil basket for holding utensils, silverware, cutlery, and the like, may also be provided and is generally removably mounted to the door or within the dish rack.

Any one of the soiled dishes or utensils, silverware, cutlery, and the like, can be positioned for cleaning in the dish rack. In some cases when moving the dish rack in and out of the dishwasher, one of the soiled dishes or utensils, silverware, cutlery, and the like, can hit, become stuck by or otherwise interact with the sprayer making movement into the dishwasher difficult or cease for the dish rack. Inconveniently, users have to remove the dish rack, inspect the dish rack for the dish causing an interaction, reposition or remove the dish and attempt to move the dish rack back into the dishwasher.

BRIEF DESCRIPTION

The disclosure relates to a dishwasher for treating dishes according to a cycle of operation, the dishwasher comprising a tub at least partially defining a treating chamber; a dish rack movably received within the treating chamber, configured for receiving dishes for treatment during the cycle of operation, and moveable relative to the tub; a displaceable sprayer located within the treating chamber, configured to emit spray into the dish rack, and displaceable within a range of movement; a deflector operably coupled to the sprayer wherein the sprayer is displaced along the range of movement in response to the relative movement between the dish rack and tub bringing a dish within the dish rack into contact with the deflector.

Another aspect of the disclosure relates to a dishwasher a method for protecting a sprayer located in a treating chamber of a dishwasher, the method comprising moving an item for treating, carried by a dish rack, within a treating chamber; during the moving, contacting, with the item for treating, a deflector coupled to a sprayer and in a first position; and pushing, with the item for treating, a wall of the deflector.

DETAILED DESCRIPTION

Figure 1:
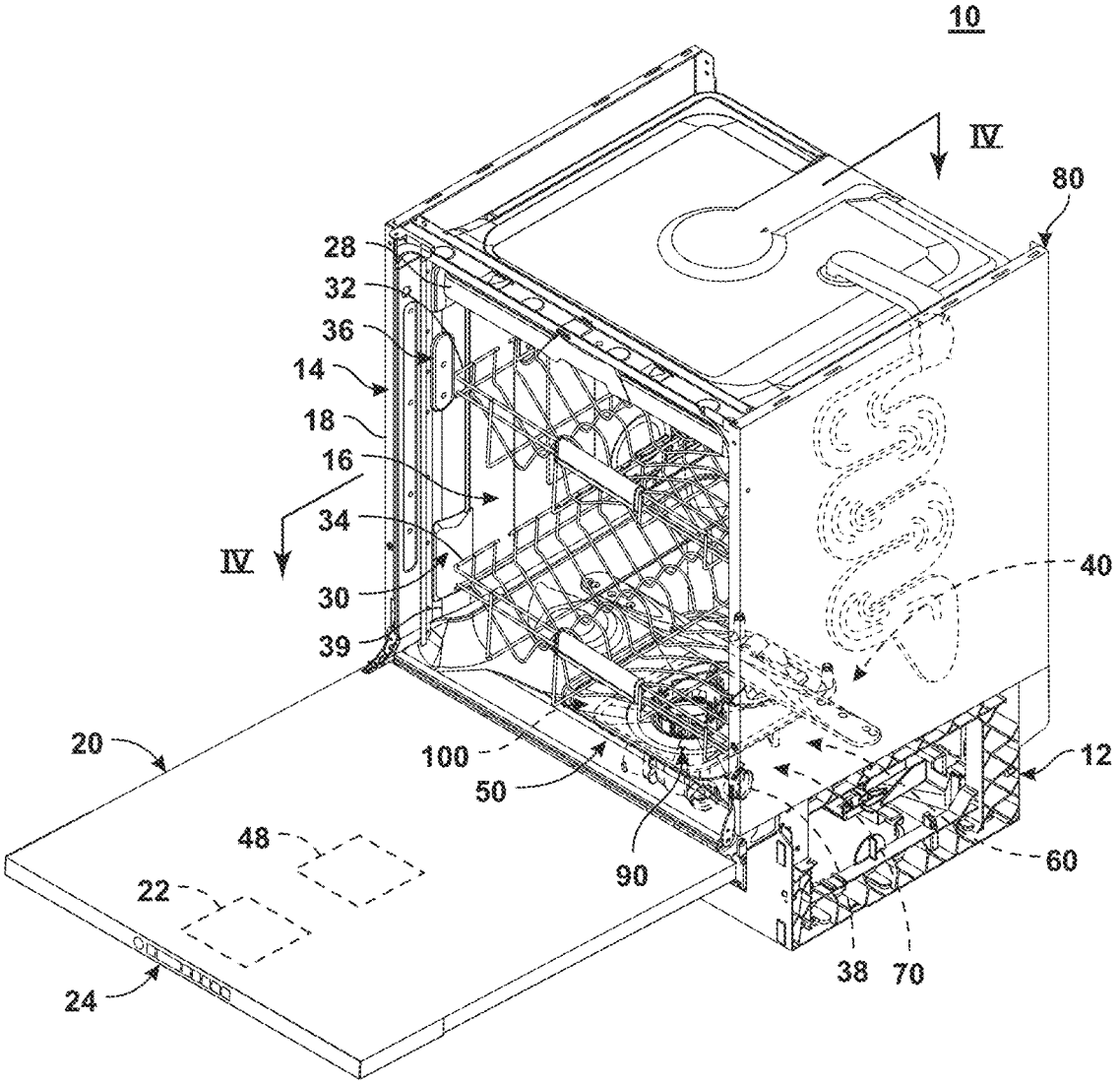
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slideably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
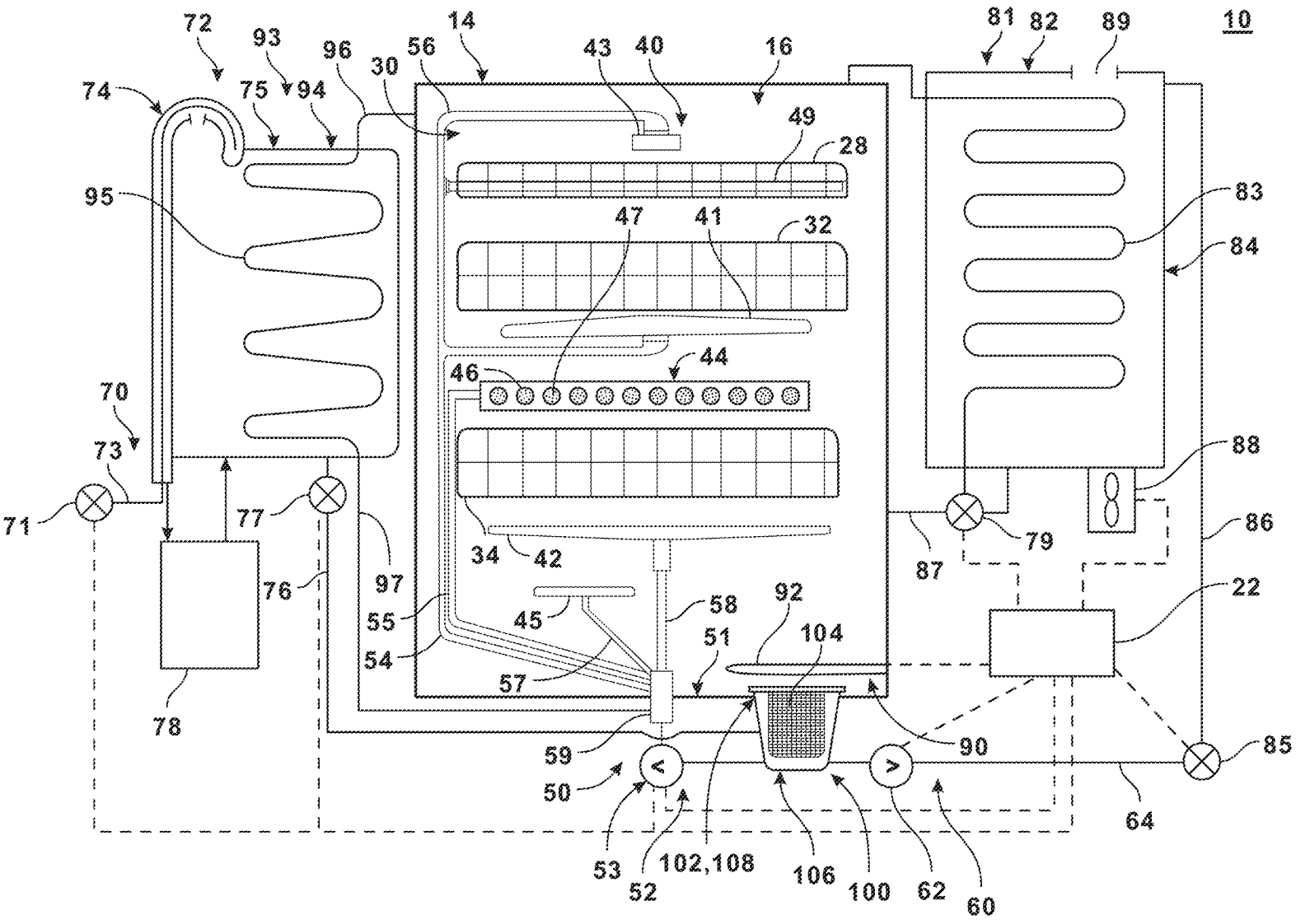
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 49 can be located at least in part below a portion of the third level rack 28. The sprayer 49 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 43, 44, 45, 49 to the recirculation pump 53. A recirculation valve 59 can selectively fluidly couple each of the conduits 54-58 to the recirculation pump 53. While each sprayer 43, 44, 45, 49 is illustrated as having a corresponding dedicated supply conduit 54-58 one or more subsets, comprising multiple sprayers from the total group of sprayers 43, 44, 45, 49, can be supplied by the same conduit, negating the need for a dedicated conduit for each sprayer. For example, a single conduit can supply the upper spray arm 41 and the third level sprayer 43. Another example is that the sprayer 49 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
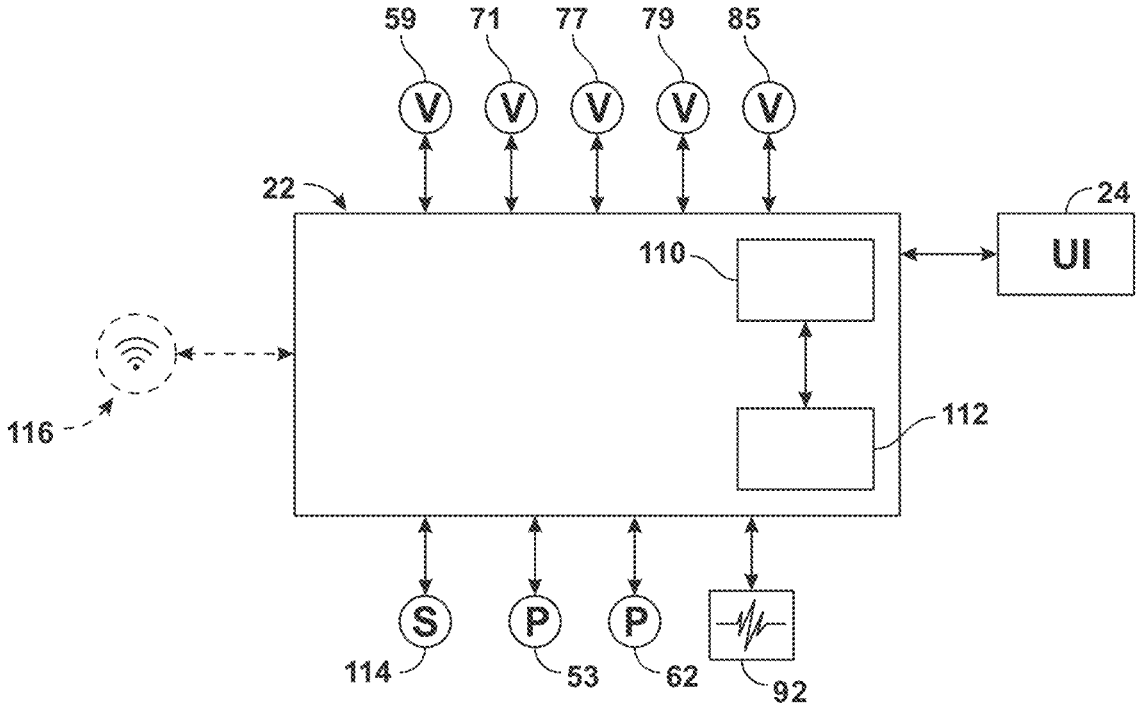
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
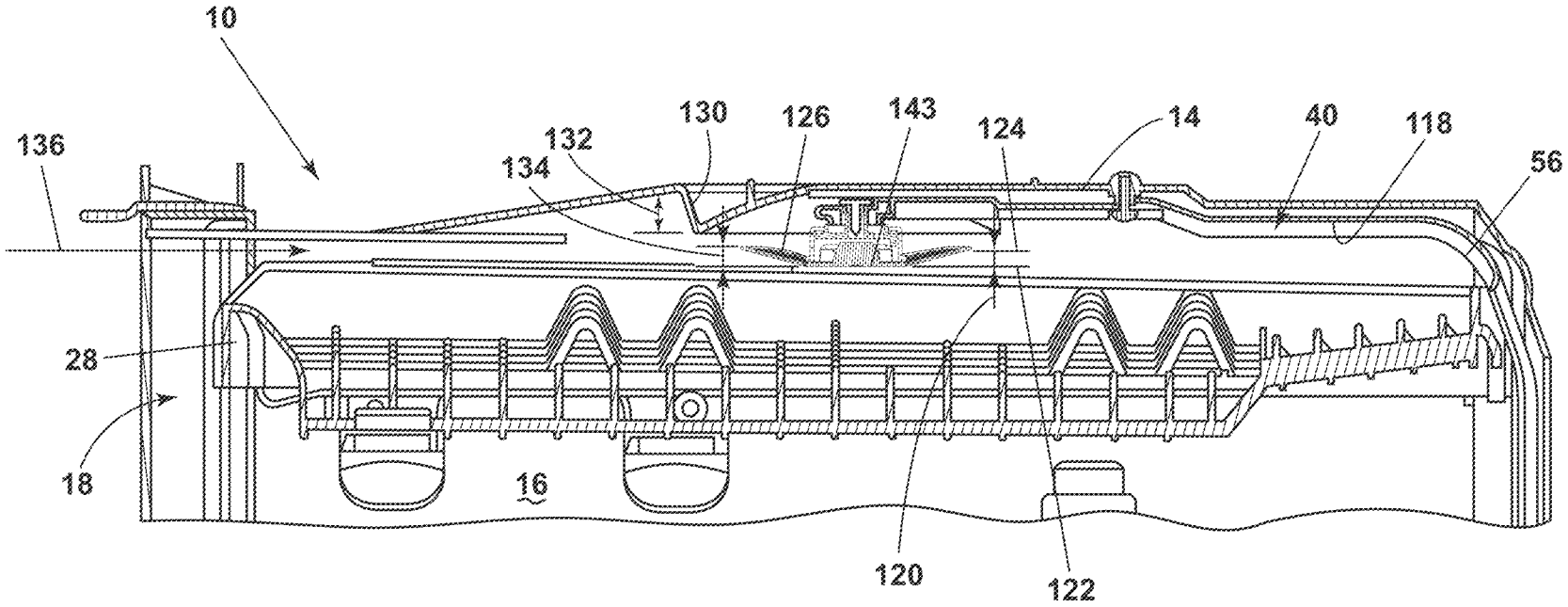
FIG. 4 is an enlarged cross-sectional view of the automatic dishwasher from FIG. 1 with a displaceable sprayer located at a top of the dishwasher.

FIG. 4 is an enlarged cross-sectional view of the dishwasher 10 from FIG. 1 illustrating a displaceable sprayer 143 located at a top 118 of the tub 14. Supply conduit 56 can be fluidly coupled to the displaceable sprayer 143. The displaceable sprayer 143 can be moved within a range of movement 120 illustrated as a vertical displacement. The range of movement is measured from a first position 122 corresponding with an initial state of the displaceable sprayer 143, as illustrated, and a second position 124 corresponding with a displacement of the displaceable sprayer 143. A deflector 126 can be operably coupled to the displaceable sprayer 143 in order to block any incoming dishware from hitting the displaceable sprayer 143 and in turn cause the displaceable sprayer 143 to move to the second position 124.

The dishwasher 10 can further include a blocking wall 130 extending from the top 118 into the treating chamber a first vertical dimension 132. When in the first position 122, the deflector 126 can extend upward toward the top 118 a second vertical dimension 134. In some implementations the first and second dimensions 132, 134 do not overlap as illustrated. It is further contemplated that the first and second dimensions 132, 134 do overlap. In other words, the blocking wall 130 can block a line of sight 136 from the open face 18 of the treating chamber 16 to the displaceable sprayer 143. When the first and second dimensions 132, 134 overlap, at least a portion of the deflector 126 is also blocked by the blocking wall 130. When the first and second dimensions 132, 134 do not overlap, the deflector 126 is completely within the line of sight 136.

Figure 5:
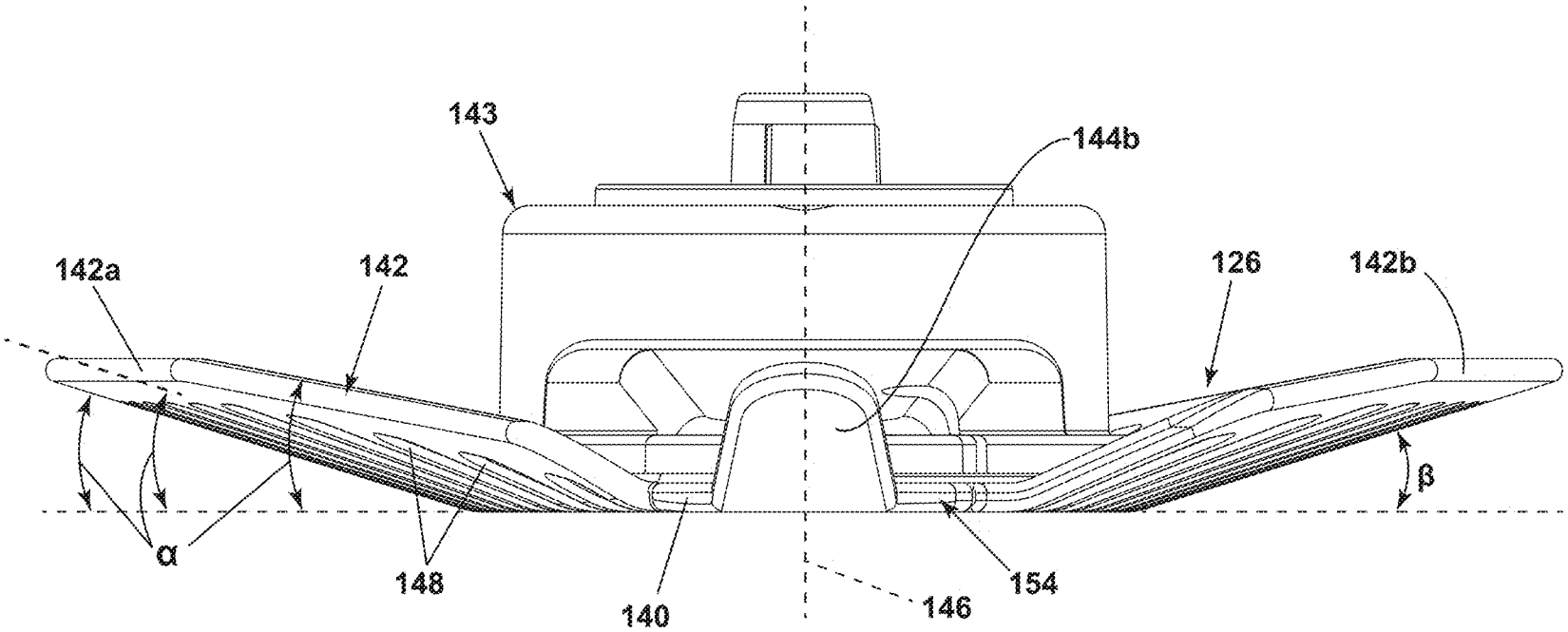
FIG. 5 is an enlarged side view of a deflector mounted to the displaceable sprayer of FIG. 4.

FIG. 5 is an enlarged side view of the displaceable sprayer and the deflector 126. The deflector 126 can include a base portion 140. The deflector 126 can be mounted to the displaceable sprayer 143 at a central location 146 of the base portion 140. A deflector wall 142 can extend upward from the base portion 140 at a predetermined angle (a) to define an angled portion. The deflector wall 142 can transition between various predetermined angles (a) ranging between 0 and 50 degrees as illustrated.

It is contemplated that the deflector wall 142 is multiple deflector walls 142*a*, 142*b*, 144*a*, 144 *b* (not visible). In an exemplary deflector 126, the multiple deflector walls are a first pair of deflector walls 142*a*, 142*b* and a second pair of deflector walls 144*a*, 144*b* each of the first and second pairs extending from opposing sides 154 of the base portion 140. At least one of the first pair of deflector walls 142*a*, 142*b* can include slots 148 defining a slotted deflector wall 142*a*. It is further contemplated that the first pair of deflector walls 142*a*, 142*b* extend upward from the base portion 140 at corresponding predetermined angles (α), (β) that differ in both individual value and a range of values from each other. The corresponding predetermined angles (α), (β) can also have individual values and a range of values that are equal to each other.

Figure 6:
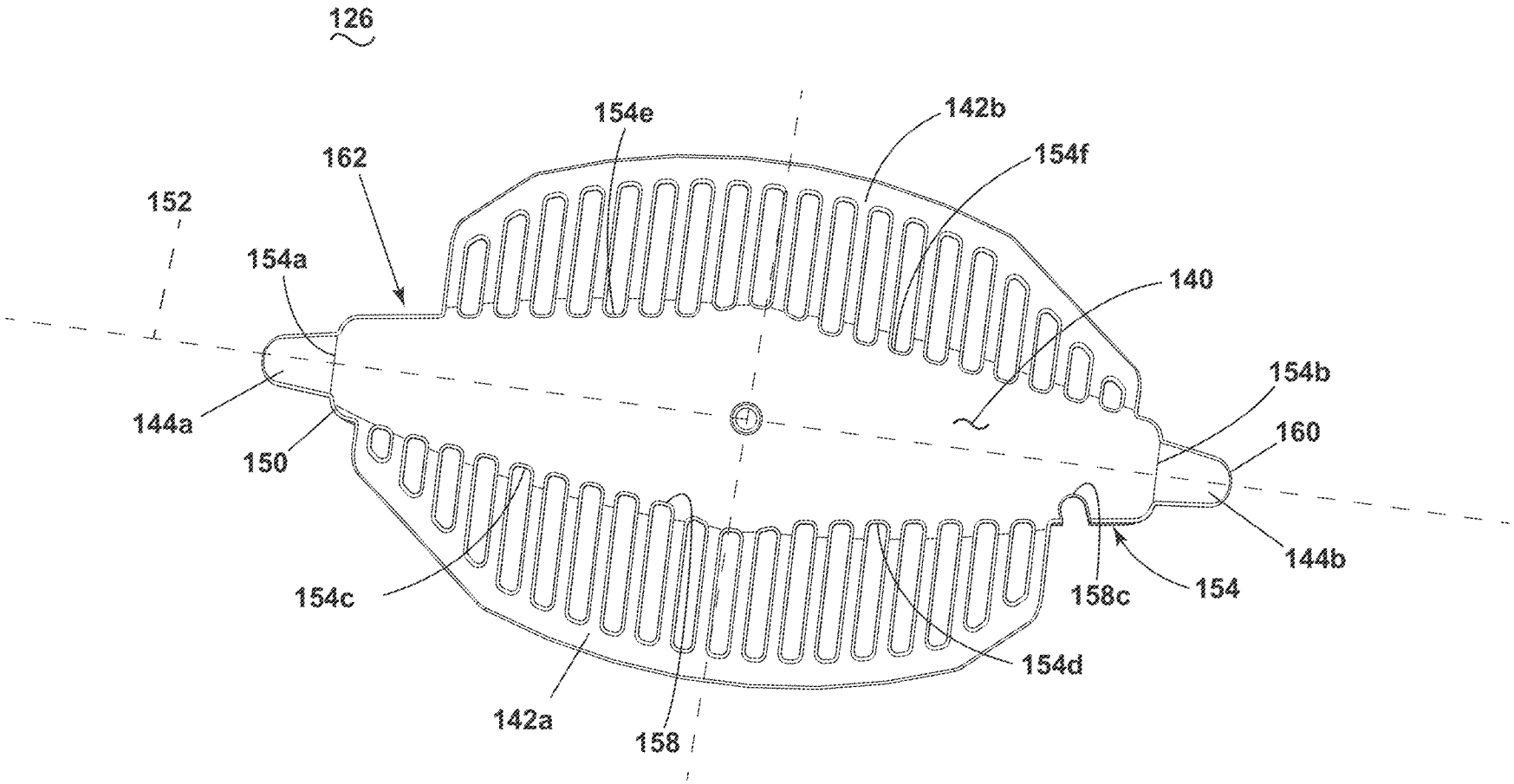
FIG. 6 is a perspective bottom view of the deflector of FIG. 5.

Turning to FIG. 6, a perspective bottom view of the deflector 126 more clearly illustrates the first and second pairs of deflector walls 142*a*, 142*b*, 144*a*, 144*b*. The base portion 140 can have a generally hexagonal shape 150 elongated along a first axis 152, bound by the opposing sides 154, and terminating in opposing tip sides 154*a*, 154*b*. A second axis 156 can split the base portion 140 into quadrants, each quadrant including one of a remaining four sides 154*c*, 154*d*, 154*e*, 154*f*. Sides 154*c*, 154*d* can correspond with opposing side 154 from which deflector wall 142*a* extends and sides 154*e*, 154*f* can correspond with opposing side 154 from which deflector wall 142*b* extends. While illustrated as a generally hexagonal shape 150, the base portion 140 can have any shape with any number of sides including a circle from which a single deflector wall 142 extends to define a bowl shape.

The first pair of deflector walls 142*a*, 142*b* is illustrated as a pair of slotted walls 142*a*, 142*b* each having multiple slots 148. The slots 148 can vary in length. At least one base cut-out 158 can be formed in the base portion 140 and define at least a portion of each of the slots 148 extending into the base portion 140.

The second pair of deflector walls 144*a*, 144*b*, is illustrated as a pair of tip walls 144*a*, 144*b* extending from opposing tip sides 154*a*, 154*b* and generally along first axis 152. The pair of tip walls 144*a*, 144*b* can each have a wider base at the opposing tip sides 154*a*, 154*b* and terminate in a rounded corner 160. At least one of the opposing sides 154 includes a sprayer section 162 free of the deflector wall 142. In at least one aspect of the disclosure the sprayer section 162 can include an enlarged cut-out 158*e*.

Figure 7:
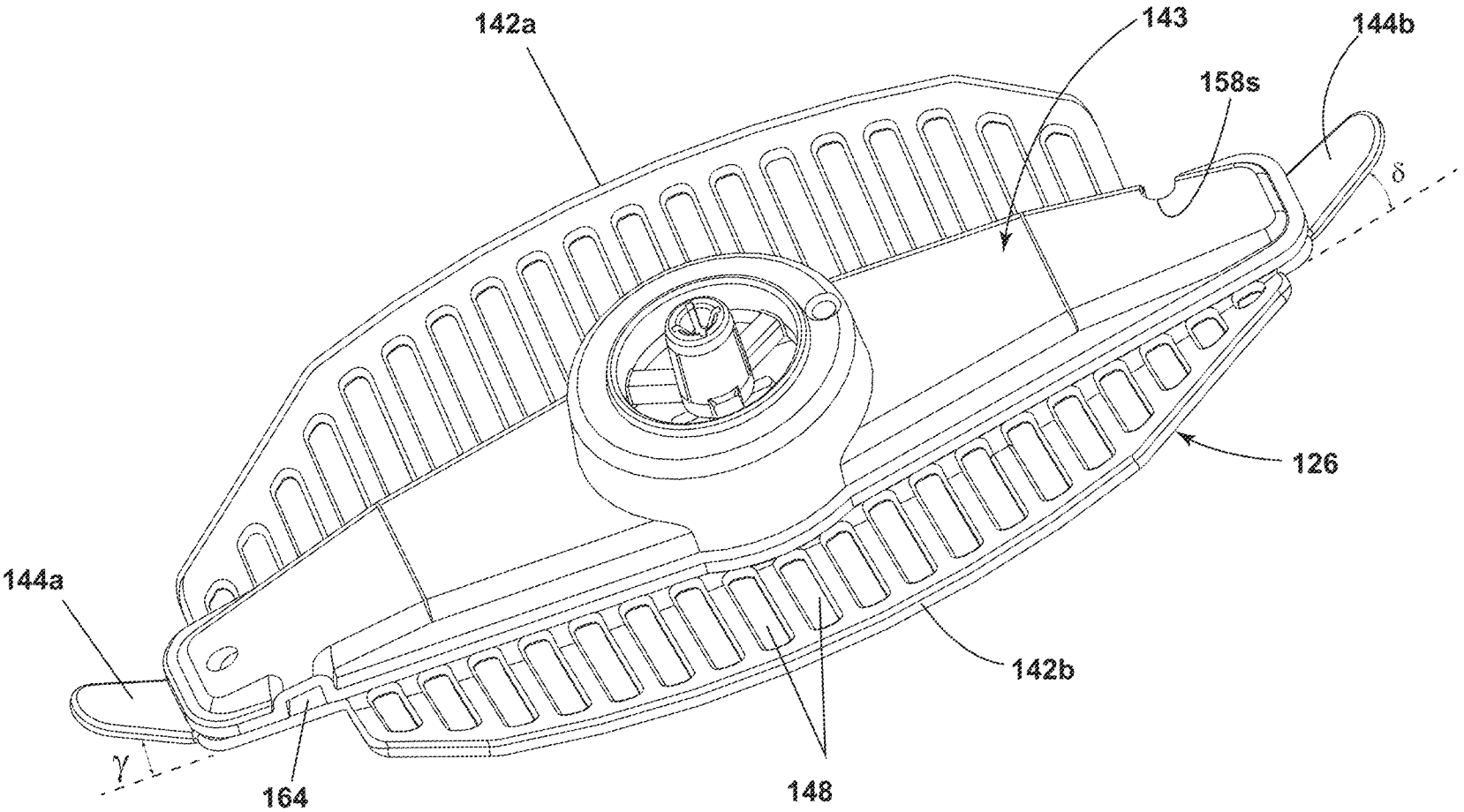
FIG. 7 is a perspective top view of the displaceable sprayer and deflector of FIG. 5.

FIG. 7 is a perspective top view of the deflector 126 mounted to the displaceable sprayer 143. The displaceable sprayer 143 can include a sprayer cut-out 158*s* that can align with the enlarged cut-out 158*e* (FIG. 6). At least one spray outlet 164 can be located along the displaceable sprayer 143 to dispense water during operation. The displaceable sprayer 143 can have a shape complementary to the base portion 140 such that the displaceable sprayer 143 mounts to the base portion 140 with the deflector wall 142 at least partially surrounding the displaceable sprayer 143. It can more clearly be seen that pair of tip walls 144*a*, 144*b* can extend upward from the base portion 140 at corresponding predetermined angles (γ), (δ), that differ in value and range of values from each other. The corresponding predetermined angles (γ), (δ), can also have values and a range of values that are equal to each other.

Each of the multiple deflector walls 142*a*, 142*b*, 144*a*, 144*b* can extend upward from the base portion 140 at their corresponding predetermined angles (α), (β), (γ), (δ), where the corresponding predetermined angles (α), (β), (γ), (δ) can have values and a range of values equal to each other or different from each other.

Figure 8:
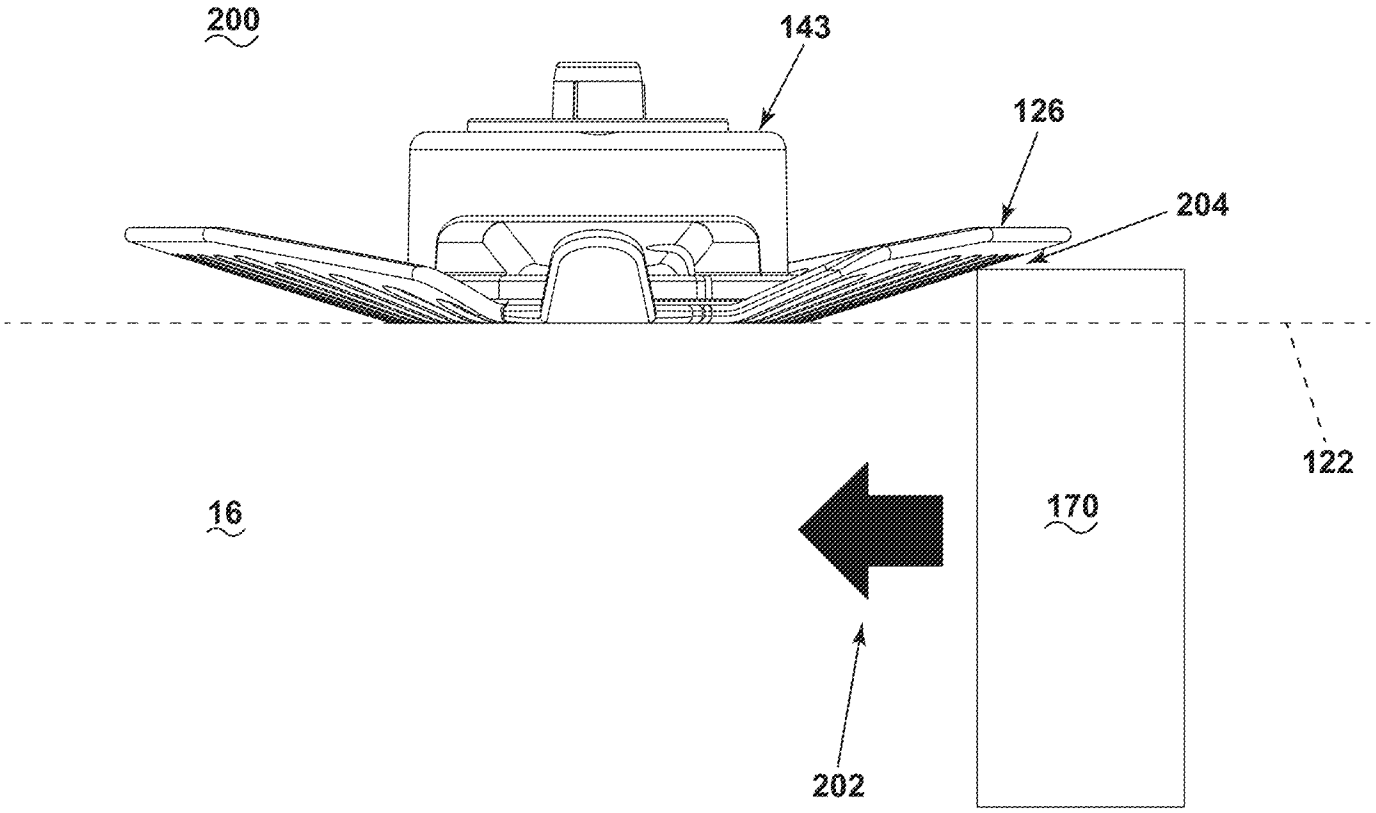
FIG. 8 is a side view of the displaceable sprayer and deflector illustrating a method of protecting the sprayer when an item for treating comes in contact with the deflector.

Turning to FIG. 8, a method for protecting a sprayer, by way of non-limiting example the displaceable sprayer 143 as described herein can include at 202 moving an item for treating 170 carried by a dish rack, by way of non-limiting example the third level rack 28 (FIG. 4). The movement can be into or out of the treating chamber 16. During the moving, the method can include contacting 204, with the item for treating 170, the deflector 126 as described herein, in the first position 122.

Figure 9:
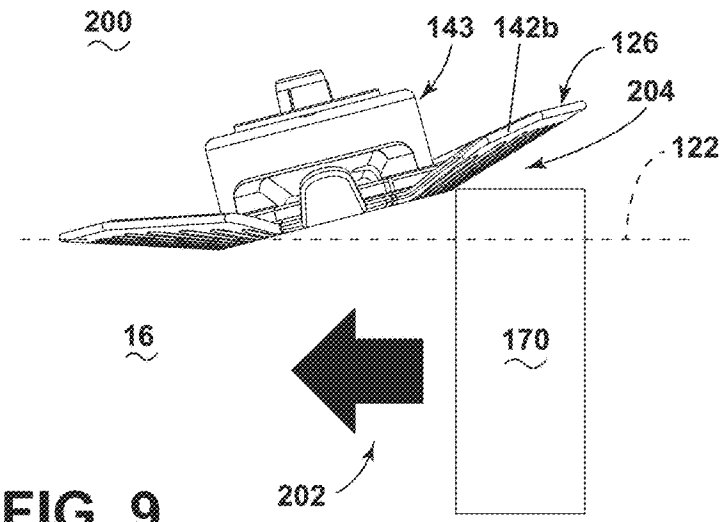
FIG. 9 is a side view of the displaceable sprayer and deflector illustrating another step of the method of protecting the sprayer when an item for treating comes in contact with the deflector.

As illustrated in FIG. 9, the method can include at 206 pushing with the item for treating 170 a wall of the deflector 126, by way of non-limiting example deflector wall 142*b*.

Figure 10:
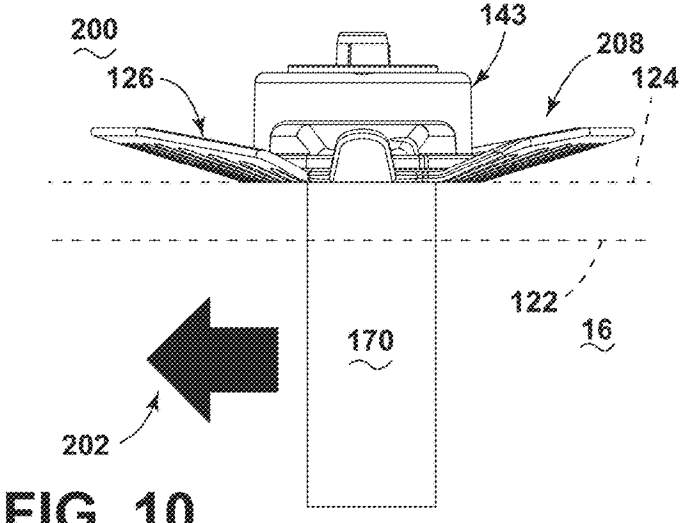
FIG. 10 is a side view of the displaceable sprayer and deflector illustrating another step of the method of protecting the sprayer when an item for treating comes in contact with the deflector.

As illustrated in FIG. 10, pushing the deflector wall 142*b* can include at 208 moving the deflector 126 into a second position 124.

Figure 11:
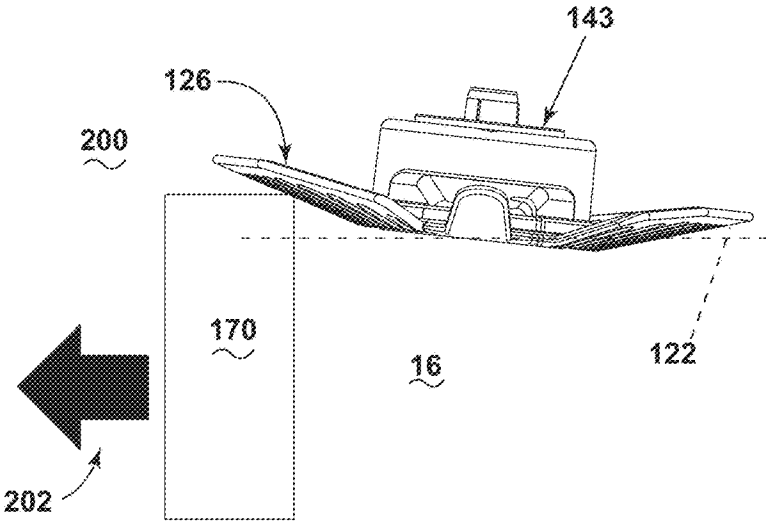
FIG. 11 is a side view of the displaceable sprayer and deflector illustrating another step of the method of protecting the sprayer when an item for treating comes in contact with the deflector.

FIG. 11 illustrates movement back into the first position 122 as the item for treating 170 passes under the deflector 126.

Figure 12:
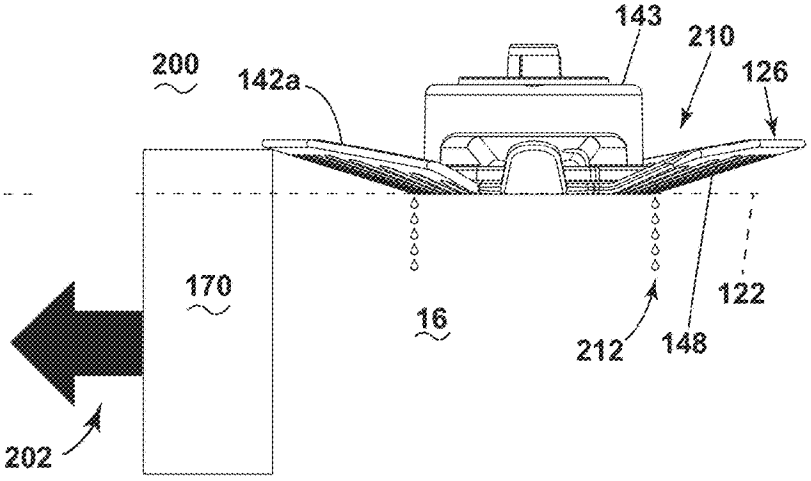
FIG. 12 is a side view of the displaceable sprayer and deflector illustrating another step of the method of protecting the sprayer when an item for treating comes in contact with the deflector.

FIG. 12 illustrates at 210 restoring the deflector to the first position. The deflector can be restored to the first position 122 when the dish rack 28 is received within the treating chamber 16 or when the dish rack 28 is extending out of the treating chamber 16. The method can further include at 212 draining the deflector 126 of liquid via the slots 148 located in the pair of slotted walls 142*a*, 142*b* as described herein.

Benefits associated with the disclosure described herein include protecting both dishes received in a dishwasher along with the sprayer itself. This can result in longevity of life and decrease a need for replacement parts. Further, the slotted walls as described herein provide drainage to prevent moisture build up when the dishwasher is not in use.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to a cycle of operation, the dishwasher comprising:

a tub at least partially defining a treating chamber;

a dish rack movably received within the treating chamber, configured for receiving dishes for treatment during the cycle of operation, and moveable relative to the tub;

a sprayer located within the treating chamber, configured to emit spray into the dish rack and displaceable between a first vertical position and a second vertical position closer to a top of the tub than the first vertical position; and a deflector having a base portion fixed to the sprayer;

wherein the deflector includes at least one wall that extends away from the base portion such that the at least one wall is positioned to prevent contact between the dishes in the dish rack and the sprayer.

2. The dishwasher of claim 1, wherein displacement of the deflector caused by contact between the deflector and one or more of the dishes in the dish rack causes corresponding displacement of the sprayer relative to the tub.

3. The dishwasher of claim 2, wherein the sprayer is movably connected to a top wall of the tub.

4. The dishwasher of claim 1, comprising a supply conduit fluidly coupling the sprayer with a pump.

5. A dishwasher for treating dishes according to a cycle of operation, the dishwasher comprising:

a tub at least partially defining a treating chamber;

a dish rack movably received within the treating chamber, configured for receiving dishes for treatment during the cycle of operation, and moveable relative to the tub;

a sprayer located within the treating chamber, configured to emit spray into the dish rack; and a deflector having a base portion fixed to the sprayer;

wherein the deflector includes a first pair of deflector walls and a second pair of deflector walls extending outward from the base portion; and wherein the first and second pairs of deflector walls are provided in a bowl-like shaped configuration that opens toward a top of the tub.

6. The dishwasher of claim 5, wherein the second pair of deflector walls extend outwardly from the base portion in a direction perpendicular to the first pair of deflector walls.

7. The dishwasher of claim 6, wherein the first and second pairs of deflector walls extend toward the top of the tub such that inner edges of the first and second pairs of the deflector walls that are connected to the base portion are farther from the top of the tub than outer edges of the first and second pairs of deflector walls.

8. The dishwasher of claim 5, wherein displacement of the deflector caused by contact between the deflector and one or more of the dishes in the dish rack causes corresponding displacement of the sprayer relative to the tub.

9. The dishwasher of claim 8, wherein the displacement of the sprayer is toward a top wall of the tub.

10. The dishwasher of claim 5, wherein the sprayer is fluidly coupled to a supply conduit and is displaceable between a first position and a second position.

11. The dishwasher of claim 10, wherein the deflector is fixed to the sprayer to cause movement of the sprayer toward the second position to protect the sprayer in response to one or more of the dishes in the dish rack contacting the deflector.

12. The dishwasher of claim 5, wherein the base portion is hexagonal.

13. A dishwasher for treating dishes according to a cycle of operation, the dishwasher comprising:

a tub at least partially defining a treating chamber;

a dish rack movably received within the treating chamber, configured for receiving dishes for treatment during the cycle of operation, and moveable relative to the tub;

a sprayer located within the treating chamber, configured to emit spray into the dish rack; and a deflector having a base portion fixed to the sprayer;

wherein the deflector includes a first pair of deflector walls extending outward from the base portion, the first pair of deflector walls including a plurality of drain slots having linear configurations and disposed in parallel with each other.

14. The dishwasher of claim 13, wherein displacement of the deflector caused by contact between the deflector and one or more of the dishes in the dish rack causes corresponding displacement of the sprayer relative to the tub.

15. The dishwasher of claim 13, wherein the deflector and the sprayer are displaceable toward and away from a top of the tub.

16. The dishwasher of claim 13, wherein the plurality of drain slots cover a majority of the first pair of deflector walls, vary in length, and are configured to facilitate draining of the deflector.

17. The dishwasher of claim 13, wherein the first pair of deflector walls includes a first deflector wall and a second deflector wall;

wherein the plurality of drain slots includes a first plurality of slots that extend through the first deflector wall and from the base portion upward toward an outer edge of the first deflector wall; and wherein the plurality of drain slots includes a second plurality of slots that extend through the second deflector wall and from the base portion upward toward an outer edge of the second deflector wall.

18. The dishwasher of claim 13, wherein the first pair of deflector walls includes inner edges connected to the base portion; and wherein the first pair of deflector walls extend from the base portion at an angle toward a top of the tub such that outer edges of the first pair of deflector walls are closer to the top of the tub than the inner edges.

19. The dishwasher of claim 13, wherein the base portion includes a sprayer section free of drain slots.

* * * * *